United States Patent [19]

Allen

[11] 4,102,140

[45] Jul. 25, 1978

[54] SELF-ADVANCING MINE ROOF SUPPORTS

[75] Inventor: Archelaius Dawson Allen, Leyland, England

[73] Assignee: Gullick Dobson Limited, England

[21] Appl. No.: 632,013

[22] Filed: Nov. 14, 1975

[30] Foreign Application Priority Data

Jul. 19, 1975 [GB] United Kingdom ..... 30347/75

[51] Int. Cl.[2] ..... E21D 15/44

[52] U.S. Cl. ..... 61/45 D

[58] Field of Search ..... 61/45 D; 299/31, 33; 248/357; 91/170 MP

[56] References Cited

U.S. PATENT DOCUMENTS

| | | | |
|---|---|---|---|
| 3,324,664 | 6/1967 | Allen | 61/45 D |
| 3,441,317 | 4/1969 | Dommann | 61/45 D |
| 3,848,420 | 11/1974 | Allen et al. | 61/45 D |
| 3,848,928 | 11/1974 | Nakajima | 61/45 D |
| 3,889,475 | 6/1975 | Allen | 61/45 D |
| 3,911,686 | 10/1975 | Becker et al. | 61/45 D |
| 3,921,409 | 11/1975 | Blumenthal | 61/45 D |
| 3,928,981 | 12/1975 | Parker et al. | 61/45 D |

FOREIGN PATENT DOCUMENTS

| | | | |
|---|---|---|---|
| 1,800,846 | 6/1970 | Fed. Rep. of Germany | 61/45 D |
| 2,149,380 | 4/1973 | Fed. Rep. of Germany | 61/45 D |
| 156,132 | 1/1964 | U.S.S.R. | 61/45 D |
| 181,585 | 12/1966 | U.S.S.R. | 61/45 D |
| 232,897 | 12/1969 | U.S.S.R. | 61/45 D |
| 262,050 | 1/1971 | U.S.S.R. | 61/45 D |

*Primary Examiner*—Dennis L. Taylor

*Attorney, Agent, or Firm*—Berman, Aisenberg & Platt

[57] ABSTRACT

The invention is concerned with mine-roof supports, especially self-advancing mine-roof supports and provides a support comprising a base, a shield inclined downwardly and rearwardly towards the rear of the base and pivotally attached to said base, a roof-engaging canopy pivotally attached to an upper part of the shield, hydraulically; extensible prop means operatively positioned between the base and said shield, and hydraulically-extensible prop means operatively positioned between the base and the canopy. In some preferred embodiments of the invention the shield is a completely non-roof-engaging member and the pivotal connection between the shield and the baseis such that raising and lowering of the shield, by the prop means between said shield and the base, does not involve material angular displacement of said prop means. The pivotal connection between the canopy and the shield conveniently includes a debris excluding joint between said canopy and shield. The space between the prop means supporting the shield and the prop means supporting the canopy is generally designed to provide a safe walkway for miners. The forward end of the canopy may be provided with an extensible and retractable extension bar and/or with a mineral-face-supporting sprag or plate. The support may have a side anti-flushing shield at at least one of its sides and said anti-flushing shield may be extendable and retractable laterally with respect to the support.

22 Claims, 6 Drawing Figures

-FIG. 3-

SELF-ADVANCING MINE ROOF SUPPORTS

Figure 1:
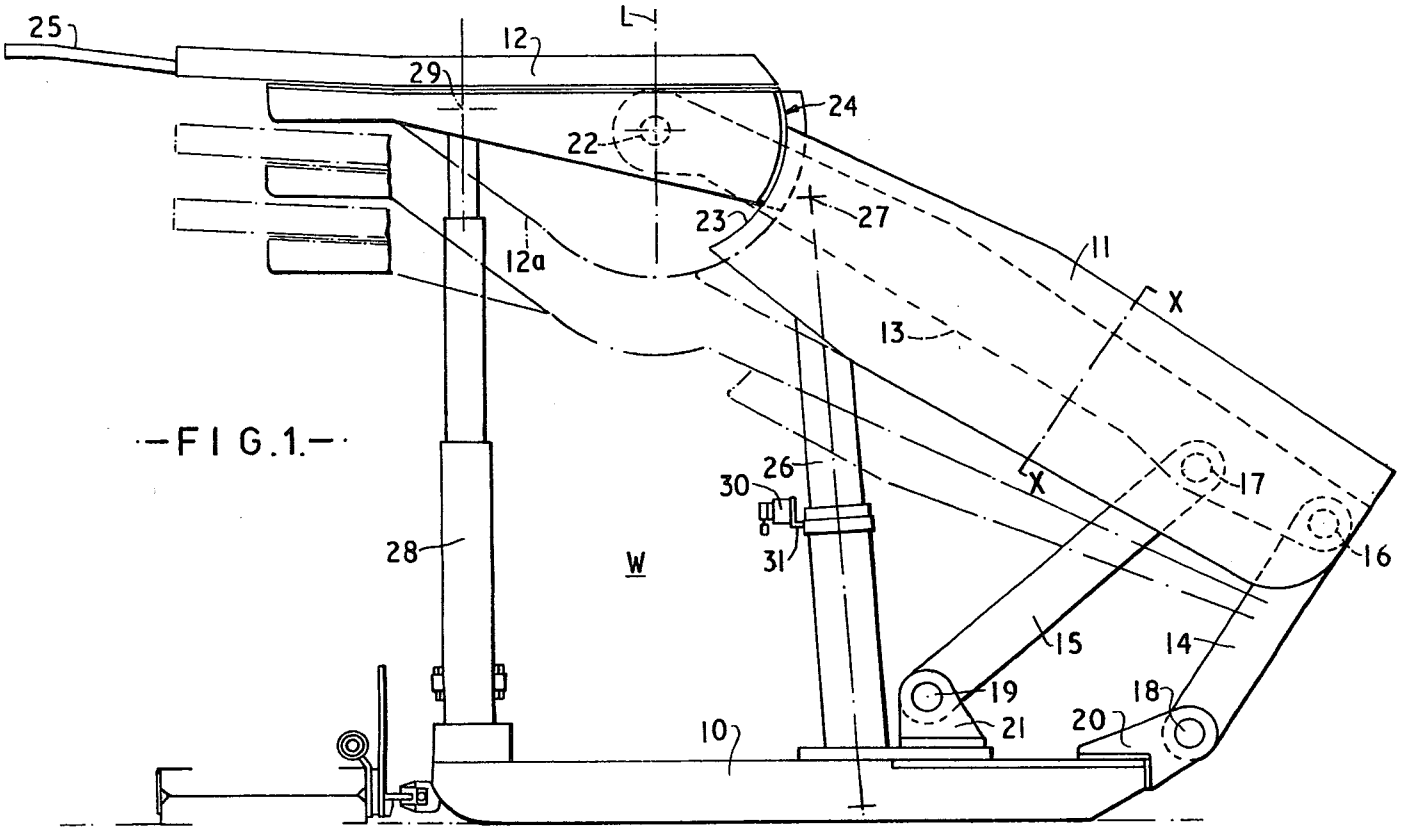

This invention is for improvements in or relating to mine-roof supports and particularly but not essentially self-advancing mine-roof supports.

According to the present invention there is provided a mine-roof support comprising a base, a shield inclined downwardly and rearwardly towards the rear of the base and pivotally attached to said base, a canopy or other roof-engaging structure pivotally attached to an upper part of the shield, hydraulically-extensible prop means positioned between the base and said shield, and hydraulically-extensible prop means positioned between the base and the canopy or other roof-engaging structure.

In preferred embodiments of the invention the shield is a completely non-roof-engaging member.

Conveniently the pivotal connection between the shield and the base is such that raising and lowering of the shield, by the prop means between said shield and the base, does not involve material angular displacement of said prop means. As a result the pivotal connection between the shield and the canopy moves along a substantially vertical line, when it is raised and lowered by the prop means.

In one preferred arrangement the pivotal attachment of the shield to the base comprises two links pivotally attached respectively to the shield at spaced points along the length thereof and to the base at spaced points therealong so as to control the attitude of the shield.

Preferably, the pivotal attachment between the canopy and the shield includes a debris excluding joint between the canopy and the shield. For example, said pivotal attachment may comprise concave and convex facings or seatings which interfit to prevent the ingress of debris at the joint between the canopy and the shield.

In some embodiments of the invention the pivotal connection between the shield and the base provides not only for angular movement of the shield in the direction of length of the support but also angular movement laterally or at right angles to the direction of advance.

The prop means may be provided with the usual means for setting them at the desired attitude i.e. vertical or otherwise. A convenient means is a hydraulic cylinder positioned between side-by-side props of the prop means and mounted on the base.

The rear edge of the canopy may project rearwardly for a substantial distance beyond the pivotal connection of the canopy to the shield. In other words the rear of the canopy overhangs materially the upper part of the shield. This ensures that the roof breaks away i.e. caves at or along the rear edge of the canopy. Satisfactory caving is ensured by the loading of the canopy by providing it with substantial prop means.

A walkway is conveniently provided for miners between the prop means supporting the shield and the prop means supporting the canopy. The prop means supporting the canopy can be located close to the mineral face conveyor, e.g. at the forward end of the base so as to provide stability of the mine roof support and safe protection to the miners using the walkway.

Generally the forward end of the canopy will project beyond the forward end of the base and it may be provided with an extensible and retractable extension bar and/or a face supporting sprag. The arrangement provides for an increased loading at the forward end of the canopy.

By providing the canopy with its own prop means the load on the pivotal connection between the shield and the base is reduced.

The support may be provided with an anti-flushing side shield on one or both sides and said side shield or shields may be extendable and retractable laterally by means of hydraulic cylinders.

Where the invention is applied to a self-advancing roof support, the usual advancing ram will be incorporated in the support and may, with advantage, be arranged so that there is a tendency for the forward part of the base to lift slightly during its advance.

Figure 2:
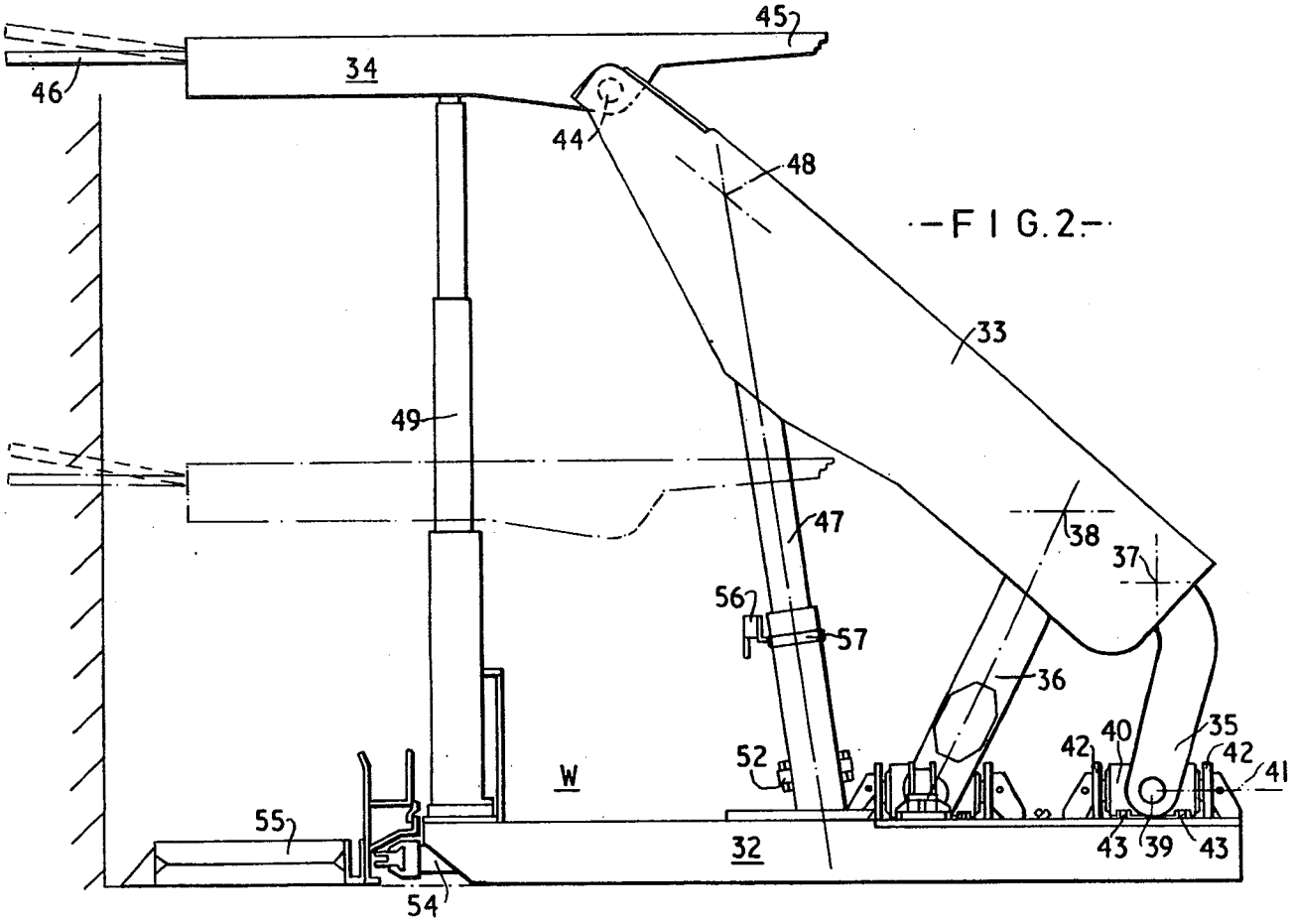
Figure 3:
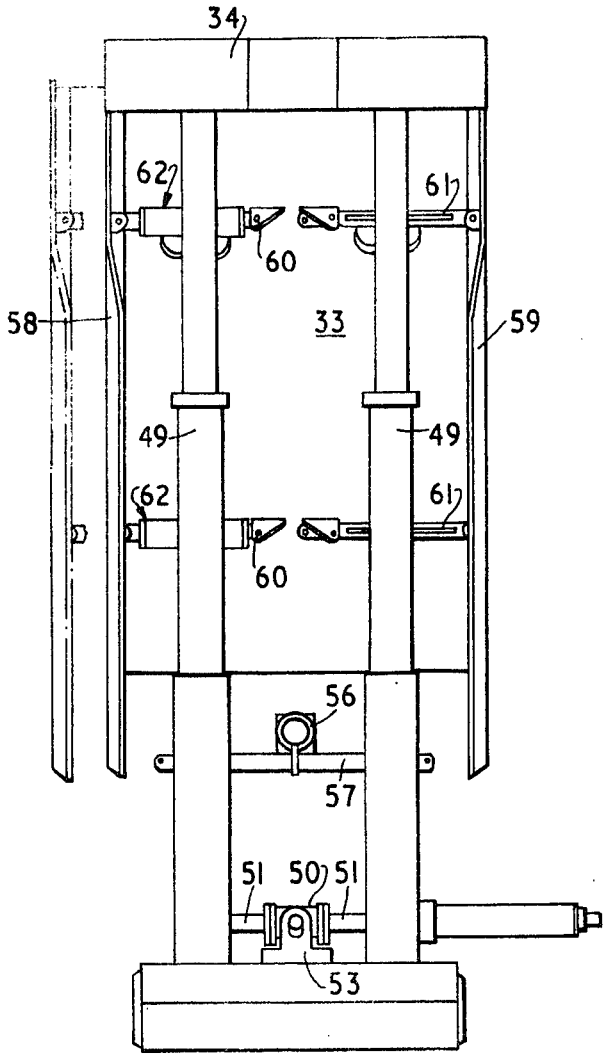
Figure 4:
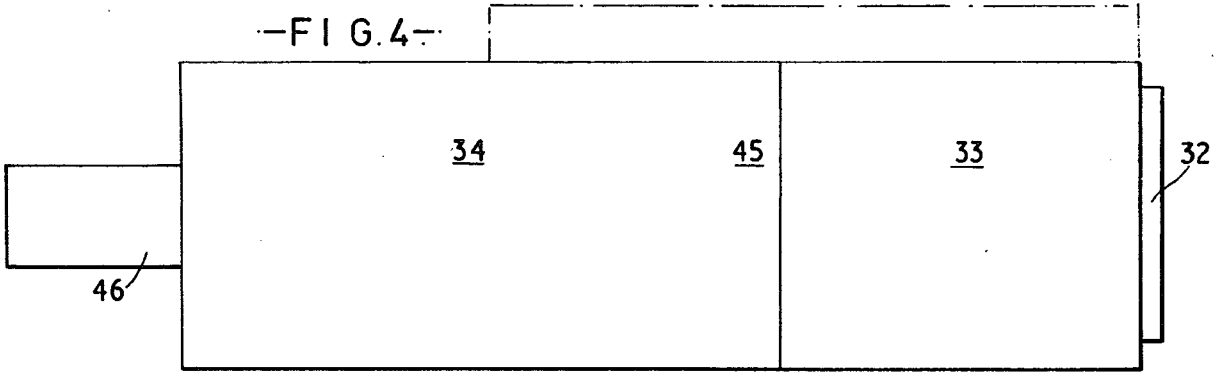
Figure 6:
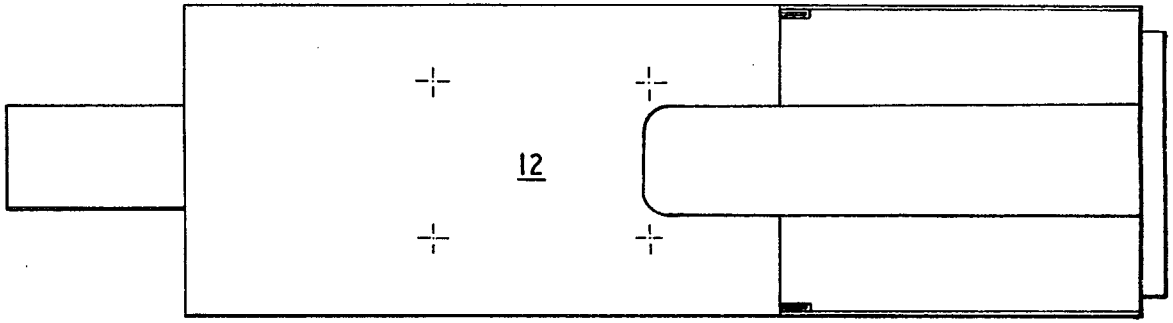
Figure 5:
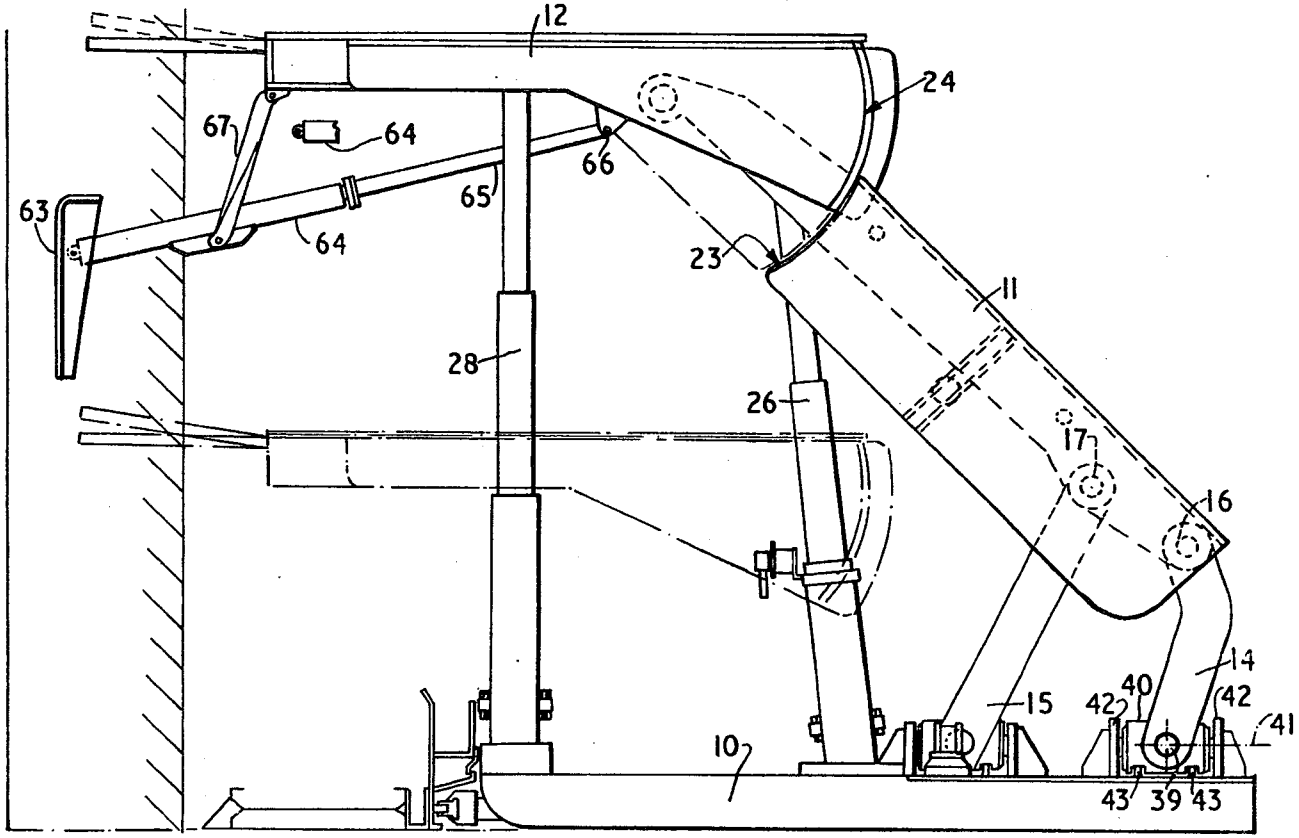

Some embodiments of the invention will now be described by way of example with reference to the accompanying semi-diagrammatic drawings in which:

FIG. 1 is a side elevation of one embodiment,
FIG. 2 is a side elevation of a second embodiment,
FIG. 3 is a front elevation of FIG. 2,
FIG. 4 is a plan view of FIG. 2,
FIG. 5 is a side elevation of a third embodiment, and
FIG. 6 is a plan view of FIG. 5.

The roof support shown in FIG. 1 comprises a base 10, a downwardly and rearwardly inclined shield 11, of "U" section on the line X—X, and a canopy 12. A rib 13 extends longitudinally of and is integral with the back or web part of the shield 11. The shield is pivotally connected to the base 10 by links 14 and 15 which are pivotally attached to the shield at 16 and 17 respectively and, at 18 and 19 respectively, to brackets 20 and 21 on the base. The link 15 is longer than the link 14.

The canopy 12 is pivotally connected to the shield 11 by a pivoting means 22 which passes through a forwardly projecting part of the rib 13.

The forward end of the shield and the rearward end of the canopy have interfitting concave and convex facings or seatings 23 and 24 respectively. This arrangement prevents the ingress of debris through the articulated joint between the shield and the canopy and into the safe walkway W provided for miners under the canopy 12.

The canopy is provided with an extensible and retractable extension bar 25.

The shield 11 is supported by a pair of side-by-side hydraulically extensible props 26 having a ball-and-socket seating (not shown) on the base 10 and a ball-and-socket connection, at 27, to the shield.

The canopy 12 is supported on a pair of side-by-side hydraulically-extensible props 28 which also have a ball-and-socket mounting (not shown) on the base 10 and a ball-and-socket connection, at 29, with the canopy.

Downwardly-extending cheek plates (indicated by chain lines at 12*a*) may be provided on opposite sides of the canopy 12 as a further shield against material falling into the support. Such cheek plates are of value more particularly on roof supports for use in high seams.

Extension of the props 26 and 28 raises the shield and canopy and brings the latter into supporting engagement with the roof. Retraction of said props releases the support from between floor and roof so that it can be advanced towards the mineral face, in the usual way, by a doubleacting hydraulic ram (not shown) incorporated in the base 10. Lowered positions of the canopy are indicated in chain lines. It will be noted that the pivot 22 moves along a vertical line L which provides the advantage that, on both low and high seams a substantially constant distance of the canopy from the mineral face is maintained.

Control of the hydraulic circuits of the support, including the props and advancing ram, is by a multi-ported selector valve 30 mounted on a bracket 31 extending between and attached to the props 26.

The support shown in FIGS. 2, 3 and 4 comprises a base 32, a downwardly and rearwardly inclined shield 33 and a canopy 34. The shield 33 is pivotally connected to the base 32 by links 35 and 36 pivotally connected to the shield at 37 and 38 respectively. The link 35 is pivotally connected at 39 to a sleeve 40 which is movable angularly about the axis 41 of a shaft mounted in brackets 42 on the base 32, thus the link 35 has, to some extent, a universal pivotal connection to the base. The angular movement of the sleeve 40 is limited by stops 43. The link 36 is similarly connected to the base 32.

The canopy 34 is pivotally connected to the shield 33 at 44. It will be noted that the rear of the canopy projects well beyond the pivot 44 as indicated at 45. The canopy is provided with an extensible and retractable extension bar 46. Wedge of other known means may be provided for forcing the extension bar against the roof as indicated in dotted lines.

The shield 33 is supported by a pair of side-by-side hydraulically extensible props 47. The props 47 have a ball-and-socket seating on the base 32 and a ball-and-socket connection at 48 to the shield 33.

The canopy 34 is supported on a pair of side-by-side hydraulically-extensible props 49 which also have a ball-and-socket mounting on the base 32 and a ball-and-socket engagement with the canopy 34.

The ball-and-socket engagement of the props with the base and shield and canopy together with the manner in which the links 35 and 36 are pivotally connected to the base provides for automatic adjustment of the shield and canopy, so as to accommodate roof movements, not only in the direction of length of the support but also laterally, i.e. in a direction transversely of the support.

Vertical or other desired alignment or attitude setting of the props is effected by a hydraulic cylinder arranged between the props of each pair. One such cylinder for the props 47 is indicated at 50 in FIG. 3. The cylinder 50 has a single piston rod 51 which is coupled to the props as indicated at 52 (see FIG. 2) for the props 47. The cylinder 50 is pivotally mounted on the base 32 by a bearing block 53.

Incorporated in the base 32 is a double-acting hydraulic ram 54 which is coupled to the mineral face conveyor 55 and serves to advance the conveyor and then the support in the well known way.

Control of the hydraulic circuits of the supports is by a valve 56 mounted on a bracket 57 extending between and attached to the props 47.

The sides of the shield 33, which form side antiflushing shields, may as shown in FIG. 3, be separate plates 58 and 59. Said plates have flanges which rest on the shield and they are connected to the underside of the shield by anchorages 60 and 61 respectively. The anchorages 60 incorporate a hydraulic ram device 62 by which the side plate 58 may be adjusted laterally between the position shown in full lines and that shown in chain lines.

By this arrangement the plate 58 may be brought into contact with the plate 59 of a neighbouring support so as to prevent material flushing between the two supports. When a support is to be advanced, its side shield 58 may be retracted into the position shown in full lines so that there is no interference with said advance by the neighbouring side shields.

A safe walkway W for miners is provided between the pairs of props 47 and 49 and under the canopy 34.

The embodiment of the invention shown in FIGS. 5 and 6 is similar in many respects to that already described with reference to FIG. 1 and where applicable like reference numerals have been used to designate like parts. The attachment of the links 14 and 15 to the base 10 is, however, as described with reference to FIGS. 2, 3 and 4 and the reference numerals used in those Figures to designate the parts of said attachment have also been used in FIG. 5.

In the embodiment shown in FIGS. 5 and 6 the forward end of the canopy 12 is provided with a sprag or plate 63 adapted to be applied to the vertical mineral face, exposed by the extraction of mineral, for the support thereof. The plate 63 is pivoted on the end of the cylinder 64 of a ram having its piston rod 65 pivotally anchored to the canopy at 66. The cylinder 64 is pivotally attached to the canopy by a link 67. By this arrangement, when the ram 64, 65 is extended, it will apply the plate 63 vertically to the mineral face and when it is retracted it will withdraw said plate and bring it to a temporarily stowed position under the canopy 12 in which position it will not interfere with the passage of a mining machine in front of the support.

I claim:

1. A mine roof face support system comprising a plurality of self-advancing mine-roof supports in a row in front of a mine-face, each said mine-roof support being coupled to a face conveyor running transversely of the row of supports and including ram means for advancing that support relative to the face conveyor and the face conveyor relative to that support, and each said mine-roof support comprising a one-piece rigid base located rearwardly of said face conveyor, a roof-engaging canopy extending over the face conveyor and a forward part of the base, a shield inclined upwardly and forwardly from the rear of the base to the rear of the canopy, first pivot means coupling an upper part of the shield to the rear of the canopy, second pivot means coupling a lower part of the shield to the rear of the base, first hydraulically extensible prop means operatively positioned between said base and said shield, and second hydraulically extensible prop means operatively positioned between said base and said canopy, the first and second hydraulically extensible prop means being spaced to afford between them a covered access running parallel with and rearwardly of the face conveyor, and the first pivot means including a linkage prescribing movement of the lower part of the shield over the base to maintain a constant vertical canopy tip position.

2. A mine-roof face support system as claimed in claim 1 wherein the shield is a completely non-roof-engaging member.

3. A mine-roof face support system as claimed in claim 1 wherein the pivot means between the shield and the base is such that raising and lowering of the shield, by the prop means between said shield and the base, is effected without material angular displacement of said prop means.

4. A mine-roof face support system as claimed in claim 1 wherein the pivot means between the shield and the base comprises two links pivotally attached respectively to the shield at spaced points along the length thereof and to the base at spaced points therealong so as to control the attitude of the shield.

5. A mine-roof face support system as claimed in claim 1 wherein the pivot means between the canopy and the shield includes a debris-excluding joint between said canopy and shield.

6. A mine-roof face support system as claimed in claim 5 wherein the pivot means between the canopy and the shield comprises concave and convex facings or seatings which interfit to prevent the ingress of debris at the joint between said canopy and shield.

7. A mine-roof face support system as claimed in claim 1 wherein the prop means have pivotal engagement with the base and with the shield and canopy and the pivot means between the shield and the base provides not only for angular movement of the shield in the direction of length of the support but also angular movement laterally or at right angles to the direction of advance.

8. A mine-roof face support system as claimed in claim 1 wherein the prop means have pivotal engagement with the base and with the shield and further comprising aligning means for setting the prop means in a desired attitude.

9. A mine-roof face support system as claimed in claim 8 wherein said aligning means is a hydraulic cylinder positioned between side-by-side props of the prop means.

10. A mine-roof face support system as claimed in claim 8 wherein said aligning means is mounted on the base of the support.

11. A mine-roof face support system as claimed in claim 1 wherein the rear edge of the canopy projects rearwardly for a substantial distance beyond the pivotal connection of the canopy to the shield.

12. A mine-roof face support system as claimed in claim 1 comprising a walkway for miners between the prop means supporting the shield and the prop means supporting the canopy.

13. A mine-roof face support system as claimed in claim 1 wherein the prop means supporting the canopy is at or close to the forward end of the base.

14. A mine-roof face support system as claimed in claim 1 wherein the forward end of the canopy projects beyond the forward end of the base.

15. A mine-roof face support system as claimed in claim 1 wherein the forward end of the canopy has a forwardly extensible and retractable extension bar.

16. A mine-roof face support system as claimed in claim 1 wherein the forward end of the canopy is provided with a mineral-face-supporting sprag or plate.

17. A mine-roof face support system as claimed in claim 1 and having a side anti-flushing shield at at least one of its sides.

18. A mine-roof face support system as claimed in claim 17 with a means for laterally extending and retracting said side shield with respect to the support.

19. A mine-roof face support system as claimed in claim 18 wherein said lateral extension and retraction means of the side shield is a hydraulic ram device.

20. A mine-roof face support system as claimed in claim 1 wherein the canopy has downwardly-extending cheek plates.

21. A mine-roof face support system as claimed in claim 1 and is provided with means whereby further comprising self-advancing means.

22. A mine-roof face support system as claimed in claim 21 wherein the support-advancing means is arranged so that there is a tendency for the forward part of the base to lift slightly during the advance of the support.

* * * * *